US005459281A

United States Patent [19]

Shibukawa

[11] Patent Number: 5,459,281

[45] Date of Patent: Oct. 17, 1995

[54] ELECTRONIC MUSICAL INSTRUMENT HAVING A CHORD DETECTING FUNCTION

[75] Inventor: Takeo Shibukawa, Hamamatsu, Japan

[73] Assignee: Yamaha Corporation, Hamamatsu, Japan

[21] Appl. No.: 841,723

[22] Filed: Feb. 26, 1992

[30] Foreign Application Priority Data

Feb. 28, 1991 [JP] Japan ..... 3-034835

[51] Int. Cl.[6] ..... G10H 1/38

[52] U.S. Cl. ..... 84/637; 84/669; 84/DIG. 22

[58] Field of Search ..... 84/609, 610, 613, 84/634, 637, 650, 666, 669, DIG. 22

[56] References Cited

U.S. PATENT DOCUMENTS

| | | | |
|---|---|---|---|
| 4,184,401 | 1/1980 | Hiyoshi et al. | 84/DIG. 22 |
| 4,192,212 | 3/1980 | Yamaga et al. | 84/DIG. 22 |
| 4,205,576 | 6/1980 | Deutsch et al. | 84/DIG. 22 |
| 4,633,751 | 1/1987 | Fukaya et al. | 84/DIG. 22 |
| 4,864,907 | 9/1989 | Oguri | 84/637 |
| 4,876,938 | 10/1989 | Shinohara | 84/DIG. 22 |
| 4,887,504 | 12/1989 | Okamoto et al. | 84/DIG. 22 |
| 4,896,576 | 1/1990 | Ino | 84/DIG. 22 |
| 5,056,401 | 10/1991 | Yamaguchi et al. | 84/637 |
| 5,171,929 | 12/1992 | Usa | 84/615 |
| 5,216,188 | 6/1993 | Shibukawa | 84/637 |
| 5,221,802 | 6/1993 | Konishi et al. | 84/613 |
| 5,235,126 | 8/1993 | Bruti et al. | 84/637 |

FOREIGN PATENT DOCUMENTS 59-174894 10/1984 Japan .

*Primary Examiner*—Stanley J. Witkowski
*Attorney, Agent, or Firm*—Spensley Horn Jubas & Lubitz

[57] ABSTRACT

A CPU extracts a specified number of tones, in order of lower pitch from among notes of pressed keys and then determines a chord based on the specified tones so that a musical relationship can be established between the tones corresponding to the depressed keys and the generated chord, thus eliminating incongruity in the performance. In addition, since the chord detection is made based on the specified number of tones, there is no need to play all the constituent notes of the chord. Moreover, by storing chord pattern abbreviations in chord table memory, chords are detected in the manner that of frequently occurring abbreviated chord patterns are prioritized over infrequently occurring chord patterns.

17 Claims, 7 Drawing Sheets

CHDT(PN)

| PN | TYPE NO.TP | TYPE NAME | BIT NO. | 0 | 1 | 2 | 3 | 4 | 5 | 6 | 7 | 8 | 9 | 10 | 11 |
|---|---|---|---|---|---|---|---|---|---|---|---|---|---|---|---|
| | | | NOTE NAME | C | C# | D | D# | E | F | F# | G | G# | A | A# | B |
| 0 | 0 | M | | 1 | 0 | 0 | 0 | 1 | 0 | 0 | 1 | 0 | 0 | 0 | 0 |
| 1 | 1 | m | | 1 | 0 | 0 | 1 | 0 | 0 | 0 | 1 | 0 | 0 | 0 | 0 |
| 5 | 2 | 7th | | 1 | 0 | 0 | 0 | 1 | 0 | 0 | 1 | 0 | 0 | 1 | 0 |
| 2 | | | | 1 | 0 | 0 | 0 | 1 | 0 | 0 | 0 | 0 | 0 | 1 | 0 |
| 3 | 3 | m7th | | 1 | 0 | 0 | 1 | 0 | 0 | 0 | 1 | 0 | 0 | 1 | 0 |
| 6 | | | | 1 | 0 | 0 | 1 | 0 | 0 | 0 | 0 | 0 | 0 | 1 | 0 |
| 4 | 4 | 7thsus4 | | 1 | 0 | 0 | 0 | 0 | 1 | 0 | 1 | 0 | 0 | 1 | 0 |
| 7 | | | | 1 | 0 | 0 | 0 | 0 | 1 | 0 | 1 | 0 | 0 | 0 | 0 |
| | | | | 1 | 0 | 0 | 0 | 0 | 1 | 0 | 0 | 0 | 0 | 1 | 0 |

FIG.9

ELECTRONIC MUSICAL INSTRUMENT HAVING A CHORD DETECTING FUNCTION

BACKGROUND OF THE INVENTION

This invention relates to an electronic musical instrument that performs an automatic accompaniment by detecting a chord corresponding to a played sound.

Various kinds of electronic musical instruments which performs an automatic accompaniment by detecting a chord corresponding to a pressed key or keys have been developed. In this kind of musical instrument, a key region is generally divided into lower and upper registers and the chord is detected based on the key or keys which are pressed in the lower register.

The following two modes are generally used as chord detection modes. In the first mode (FC mode), a chord is determined based on all keys which are pressed in the lower register; in the second mode (SF mode), the chord is detected according to the key having the highest pitch among the key or keys pressed in the lower register, the type of chord (major, minor, seventh, etc.) is detected according to the combination of white and black keys pressed below the highest pitch sound key.

The latter SF mode is an abbreviated mode for beginners that determines an appropriate chord type. For example, the chord is major when only white keys are pressed below the most treble sound key, minor when only black keys are pressed, and a seventh when both white and black keys are pressed.

In FC mode, it is necessary to press keys that correspond to the notes constituting the chord to generate the desired chord, thus making performance difficult.

Also, in SF mode, the sound of the pressed key differs from the type of chord to be played because chord detection is based on the combination of keys pressed. As a result, performance in the upper and lower registers does not have the same feeling.

An electronic musical instrument, in which an abbreviated pattern for detection corresponding to a chord is memorized, is known. When the keys pressed match the abbreviated pattern, the electronic musical instrument generates a formal chord corresponding to the keys (Japanese Patent Application, Laid-Open Publication No. Sho. 59-174894). A similar incongruity, as in the case of SF mode, results even in this device from the fact that an actually generated sound has no direct relation with the depressed key or keys.

SUMMARY OF THE INVENTION

This invention was developed to solve this problem, thus enabling performance feeling to be the same in both the left and right key regions. The invention also provides an electrical musical instrument that generates the chord desired even if not all the keys that make up the chord have been pressed.

According to the present invention, performance feeling in the bass register matches that in the treble register, and at the same time, a desired chord can be generated without pressing all the keys corresponding to the chord constituent tones. Also, it is possible to achieve a performance that is not limited by a key register.

According to an aspect of the invention, the CPU (1) extracts a specified number of notes from the bass side and at the same time determines a chord based on these notes so that a musical relationship can be established between the inputted notes (notes corresponding to pressed keys) and the generated chord, thus eliminating incongruity in the performance. Also, since a chord can be detected based on a specified number of notes, it is possible to enable the chord to be detected without playing all the notes of the chord. Moreover, by storing chord pattern abbreviations in chord table memory (4), chords are detected in such a manner that frequently occurring abbreviated chord patterns are prioritized over infrequently occurring chord patterns.

BRIEF DESCRIPTION OF THE ATTACHED DRAWINGS

FIG. 9 shows a table that represents the contents of the chord table in the same embodiment.

BRIEF DESCRIPTION OF THE INVENTION

The following embodiments of the invention are described with reference to the drawings.

Figure 1:
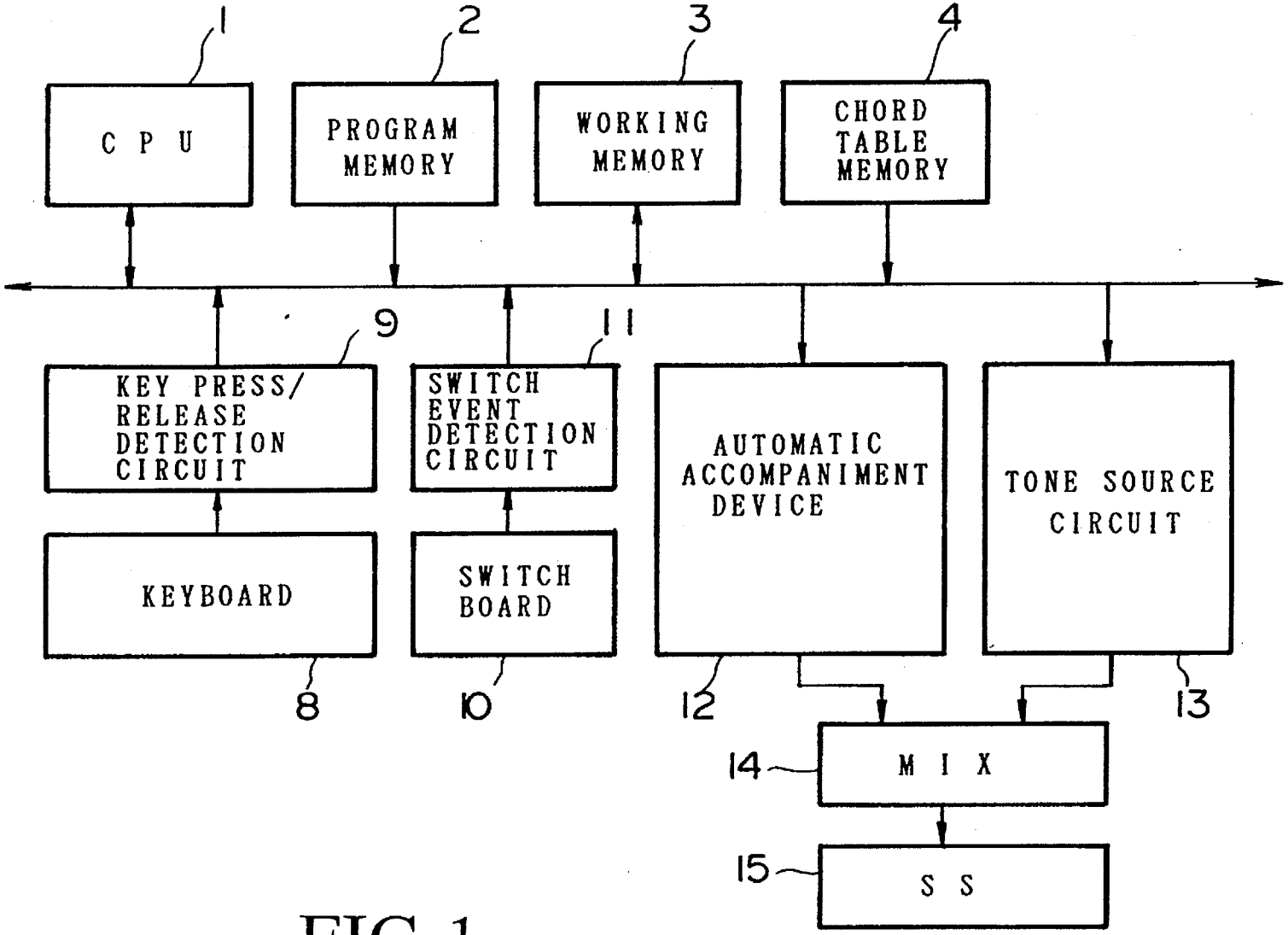
FIG. 1 shows a block diagram of the configuration in one embodiment of this invention.

FIG. 1 is a block diagram that shows one embodiment of the invention. In the figure, (1) is a CPU that controls all parts of the device, (2) is program memory consisting of ROM, and (3) is working memory consisting of RAM. (4) is chord table memory that stores the chord table shown in FIG. 9 and consists of ROM. Details on the chord table are given later. (8) shows a keyboard consisting of a plurality of keys, and (9) is a key press/release detection circuit that detects the key code KC of key that is pressed and released and then sends this code to the CPU (1). (10) is a switch board that consists of various switches to perform voice or mode setting. (11) is a switch event detection circuit that determines whether, each switch is ON or OFF; the event (ON-to-OFF or OFF-to-ON) is supplied to the CPU (1). (12) is an automatic accompaniment device that creates an accompaniment signal under the control of the CPU (1). (13) is a tone module that generates musical tone corresponding to the key code of the pressed key.

An embodiment of the invention (1) Main routine

Figure 2:
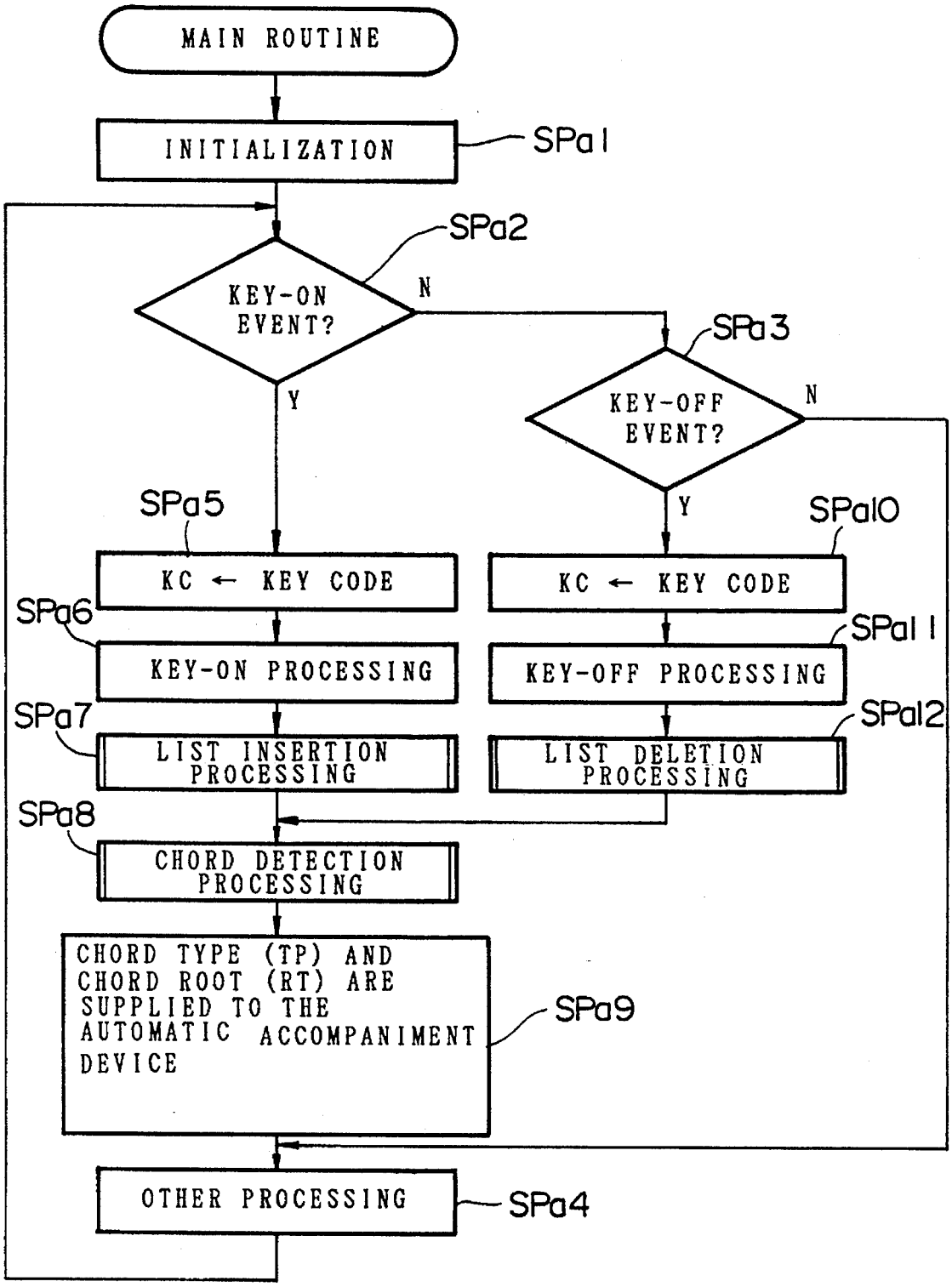
FIG. 2 shows a flowchart of the main routine of the same embodiment.

In step SPa1 shown in FIG. 2, various registers or "variables" are initialized. The presence or absence of a key-on event is determined in step SPa2. When judgment is "NO," control goes to step SPa3, thus enabling presence or absence of the key-off event to be determined. If this judgment is "NO," namely if no keys are operated, control goes to step SPa4, thus returning to step SPa2 after performing other processes (for example, scanning the switch status in switch board (10)).

Figure 3:
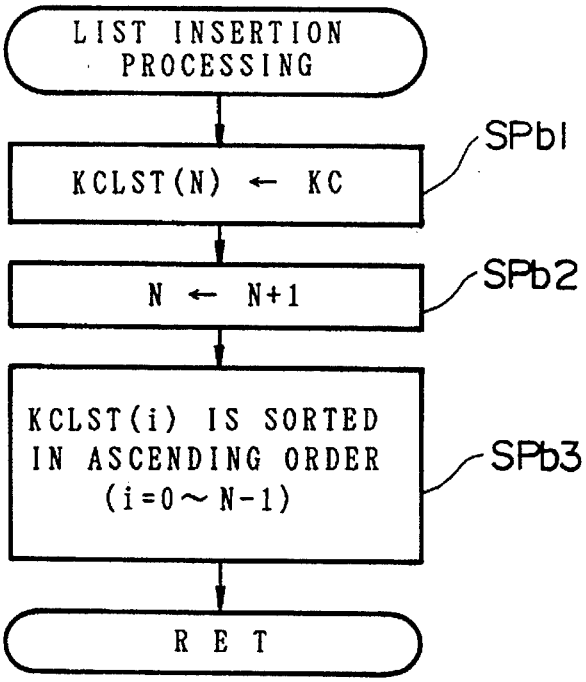
FIG. 3 shows a flowchart of the list processing in the same embodiment.

On the other hand, if a key event is detected in step SPa2, the key code of the key-on event is stored in key code register KC (step SPa5), and further, is assigned to a specified sound-generating channel for generating sound (step SPa6). Then, control goes to step SPa7 to perform list insertion processing. FIG. 3 shows this processing. First of all, the contents of the register (KC) are written to a register KCLST (N) in step SPb1. In this case, the contents of the register (KC) are written to the register KCLST (0) in step SPb1 since variable (N) has been set to 0 in the initialization processing (step SPa1). Then, variable (N) is incremented (step SPb2) and the register (KCLST (i)) is sorted in ascending order (i: 0-N-1). The sorting processing allows the contents of registers (KCLST(i)) to be arranged in ascending order when key-on events are further detected and there are a plurality of registers (KCLST (i)). Thus, after sorting, data within register KCLST(0) is the smallest, and that within register KCLST(1) is the next smallest. Namely, key codes are arranged in order of low-frequency sound. Control returns to the main routine after sorting, thus enabling chord detection processing in step SPa8 to be performed.

Figure 4:
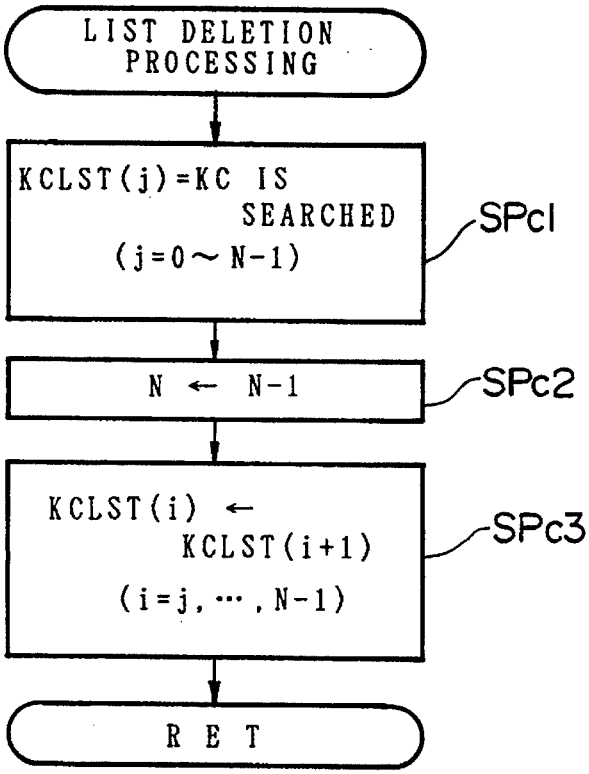
FIG. 4 shows a flowchart of the list deletion processing in the same embodiment.

On the other hand, when a key-off event is detected in the main routine, control goes to step SPa10 from step SPa3, a key code of the key-off key is stored in register (KC). After the step SPa10, key-off processing of the sound-generating channel where the key code has been assigned is performed (step SPa11). Then, control goes to step SPa12 to perform the list deletion process. This processing consists of the steps shown in FIG. 4, and searches for those which store a key-off key code out of registers KCLST (j) in step SPc1 (key code within register KC). Then, the variable (N) is decremented (step SPc2) corresponding to a reduction in the number of key codes to be stored in the register (KCLST). Control then proceeds to step SPc3, and a key code within the register (KCLST) whose number is greater by one is transferred to the register (KCLST) where a key-off key code has been stored. Next, data is transferred from register KCLST(i+1) to register KCLST(i) (step SPc3) in descending order. After this process, control returns to the main routine, thus enabling the chord detection processing of step SPa8 to be carried out.

In chord detection processing, a type number (chord type) (TP) and a chord root sound (RT) are detected based on a key code (KC) within the register (KCLST (i) (i: 0-N). (Details on this are given later.) The type number (TP) and the chord root sound (RT) detected by this processing are supplied to the automatic accompaniment device (12) shown in FIG. 1, which creates a musical tone signal (chord, bass, etc.) for automatic accompaniment. After processing in step SPa9, other processes are performed (step SPa4), and control returns to step SPa2 again.

(2) Chord detection processing

The chord detection processing is described below.

Figure 5:
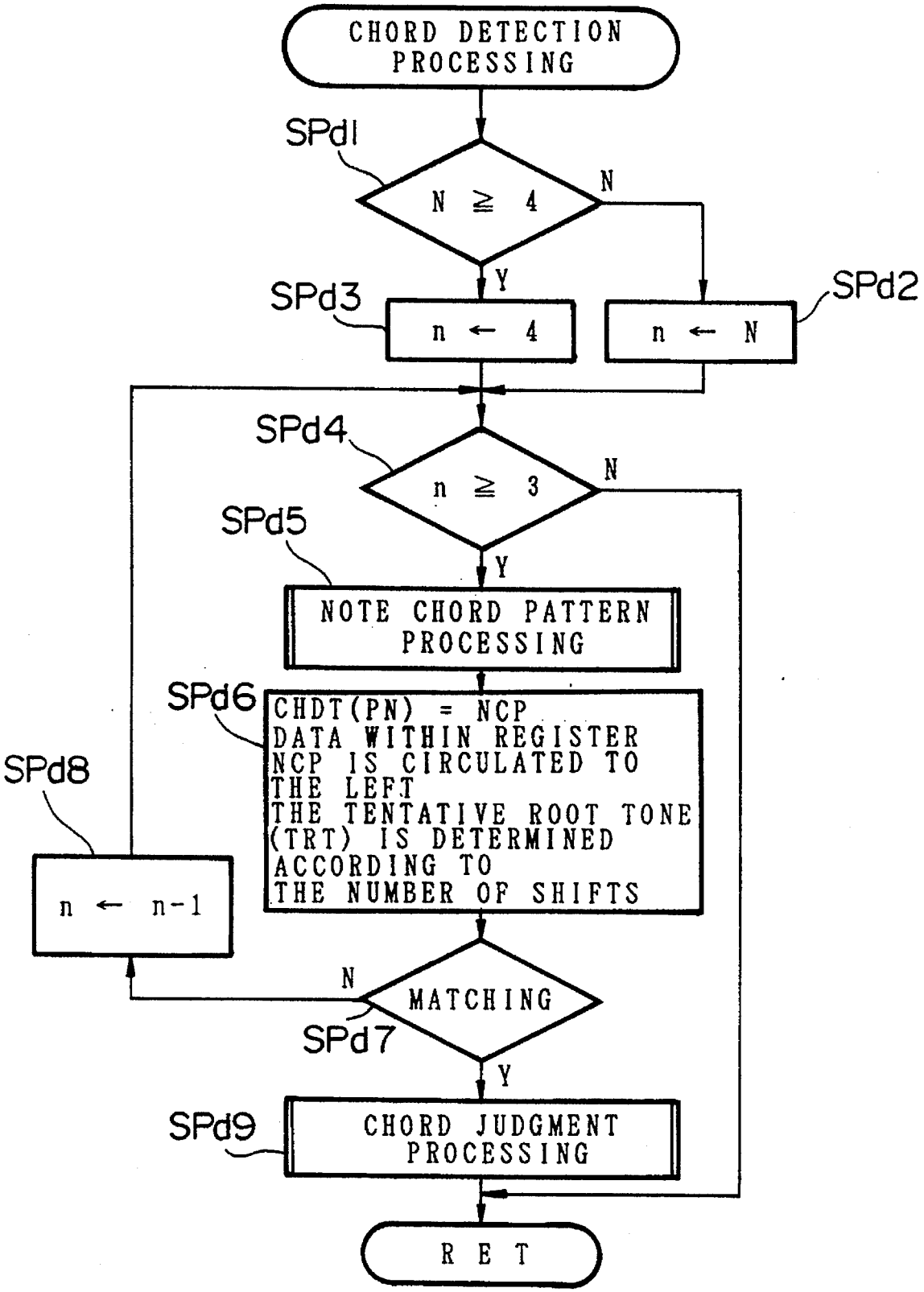
FIG. 5 shows a flowchart of chord detection processing in the same embodiment.

First, it is determined if the variable (N) is equal to or larger than 4 in step SPd1 shown in FIG. 5. Step SPd1 is used to determine if there are 4 or more key code stored in the register KCLST(i). If this judgment result is "YES", 4 is entered into variable (n) in step SPd3; the value of variable (N) is entered into variable n in step SPd2 in the case of "NO", where variable (n) determines the number of keys to be pressed for detecting the chord and the chord is detected based on a maximum of four keys in this embodiment. Thus, when the variable (N) is equal to or larger than 4 (when the judgment is determined to be "YES" in step SPd1), the value of the variable (n) is forced to be equal to 4 in step SPd3. On the other hand, when variable (N) is equal to or smaller than 3, the value of variable (N) is entered into variable (n) in step SPd2.

Next, it is determined whether the value of (n) is equal to 3 or larger in step SPd4. The next chord judgment processing is not performed in the case of "NO", thus returning to the main routine since the number of keys to be pressed which is needed for chord detection has been set to a minimum of 3 in this embodiment. If judgment is determined to be "YES" in step SPd4, the note code pattern processing of step SPd5 is performed.

Figure 6:
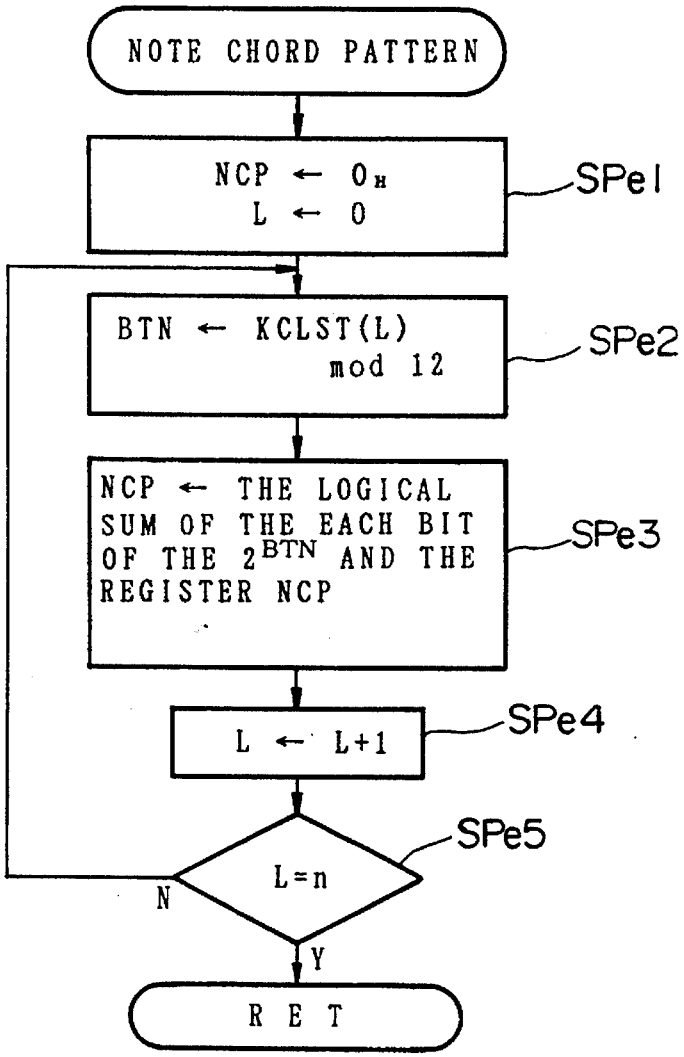
FIG. 6 shows a flowchart that describes pattern creation for the detection code in the same embodiment.

The note code pattern processing extracts the tone name of each pressed key (Details are as shown in FIG. 6). First, a register (NCP) and a variable (L) are cleared in step SPe1. Then, KCLST (L) mod12 operation is performed in step SPe2, where data within the KCLST (L) is divided by 12 to obtain the remainder corresponding to the tone name. In this embodiment, key code has been set so that C is 0 and C# is 1. The operation result is then entered into a variable (BTN). Since sorting is performed at step SPb3 (FIG. 3), operation in step SPe2 is performed based on three or four tones at a bass sound side (a side where the value of the key code is small).

When control proceeds to step SPe3, 2 raised to the BTN-th power is calculated. According to this operation result, if the tone is C, the first 0 bit becomes 1. If it is C#, the first bit becomes 1. Namely, any bit corresponding to the tone name is assigned a value of 1. The logical sum of the operation result and each bit of the register (NCP) are then calculated, and the result is again stored into register NCP. Then, the value of L is incremented in step SPe4, and it is determined whether L is equal to (N) in step SPe5. Then, the above steps (SPe2)–(SPe4) are repeated until the judgment becomes "YES". All bits in register NCP corresponding to the tone name of key-on keys become 1. Then, if the judgment becomes "YES" in the step SPe5, the processing in step SPd6 shown in FIG. 5 is performed.

In step SPd6, data at each line in Table (1) is compared with data in the register (NCP) to enable a pattern number (PT) and a tentative root tone (TRT) to be detected. The processing is described below.

First, a CHDT(0), which indicates data in the top line in the table shown in FIG. 9, is compared with data in register NCP. If they differ, data within register NCP is shifted to the left (the direction that enables each bit to be shifted to a lower order) one bit at a time, and the comparison is repeated each time. If register data does not match even after the circulation ends, data in CHDT(1) is compared with data in register NCP, where data in the register NCP is shifted and a comparison is made. In a similar manner, data in CHDT (PN) (PN: 0–7) is compared with that within register NCP. If the data matches, the tentative root tone (TRT) is determined according to the number of shifts, and the pattern number (PN) is determined according to the type of CHDT in the case of matching. The relationship between the number of shifts and the tentative root tone is that the tentative root tone (TRT) increases by a semi-tone every time the number of shifts is incremented by one (for example, C for 0 (the number of shifts), C# for 1, and D for 2).

The following describes a case where comparison is made with CHDT (5). Suppose that data within register NCP is equal to "010001001001", data within CHDT (5) is equal to "100010010010", as shown in the table, shown in FIG. 9, thus resulting in a mismatch. Then, data within register NCP is shifted to the left by one bit, thus enabling data within register NCP to match data within CHDT (5). In this case, since the number of shifts is equal to 1, the tentative root tone is C#, and matches data within CHDT (5). The pattern number (PN) is therefore 5.

After the processing in step SPd6, control goes to step SPd7, and a check is made for matching. If this judgment is "NO", data within the variable (n) is decremented by one and control returns to step SPd4. After that, steps SPd5 and SPd6 are run to enable the same matching retrieval as above to be made in three tones if no matching is achieved in four tones. Matching retrieval with three tones may be possible if the pattern number (PT) is 0, 1, 2, 6, or 7. In this case, when the pattern number (PT) is 2, 6, and 7, each represents an abbreviation for a seventh (7th), minor seventh (m7th), and seventh with a suspended fourth (7thsus4).

If no matching is obtained with three tones, the value of (n) becomes 2 according to the processing in step SPd8, and "NO" is determined in step SPd4 so that control returns to the main routine without causing chord judgment to be made.

(3) Chord judgment processing

Figure 8:
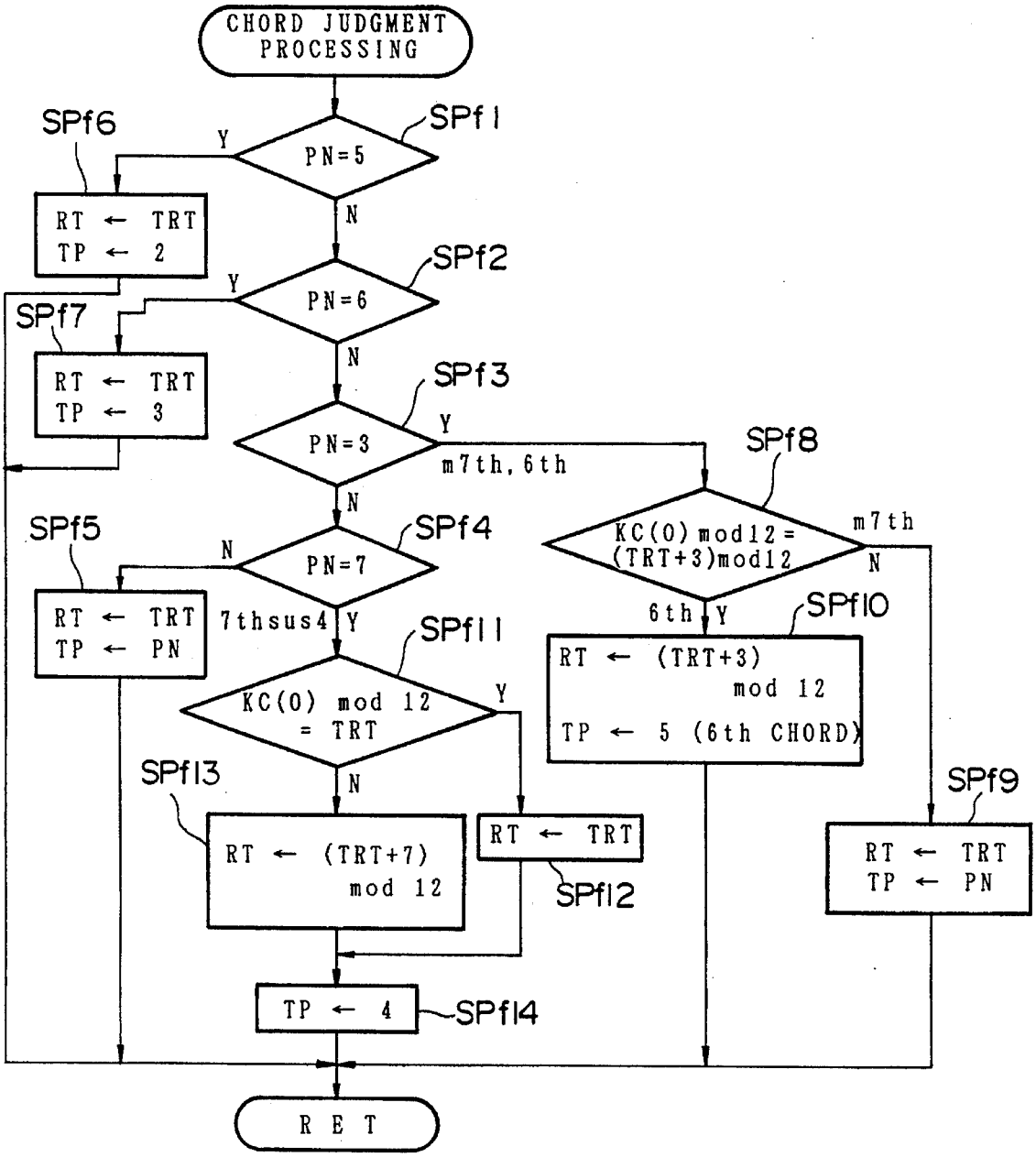
FIG. 8 shows a flowchart of chord judgment processing in the same embodiment.

The chord judgment processing in step SPd9 is described with reference to FIG. 8. In this chord judgment process, a chord is determined according to the rule shown in the table (see FIG. 9) based on the pattern number (PN) and the tentative root tone (TRT) obtained by the previously described processes. The relationship between the type number (TP) and the pattern number (PN) of a chord to be generated is as shown in the table, and the pattern number (PN) matches the type number (excluding the cases (5), (6), and (7)).

Processing steps for each pattern number are described separately since the chord judgment processing differs in processing details depending on the pattern number.

(1) If the pattern number (PN) is 0, 1, 2, or 4:

In this case, judgment in steps SPf1, SPf2, and SPf3 (shown in FIG. 8) is "NO", and judgment in step SPf4 is "YES", thus enabling control to go to step SPf5. The value of the tentative root tone (TRT) is to be entered into the root tone register (RT), and the pattern number (PN) is to be adopted as the type number (TP). Namely, when the chord is major M, minor m, a seventh (7th) (abbreviated form), or a seventh with a suspended fourth (7thsus4) (complete form), the tentative root tone is determined to be a root tone, and the tone-generating direction is made according to the same type number (TP) as the pattern number (PN).

(2) If the pattern number (PN) is 5 or 6:

If the pattern number (PN) is 5 or 6, the judgment of the step SPf1 or step SPf2 is "YES", and steps SPf6 or SPf7 are processed. Namely, the tentative root tone (TRT) is adopted as the root tone (RT), as in the above case, but the type number (TP) is 2 or 3 according to Table 1.

(3) If the pattern number (PN) is 3:

If the pattern number (PN) is 3, the chord type is a minor seventh (m7th) according to the table (see FIG. 9). When this chord is inverted, it becomes the same as a sixth (6th) chord. Thus, the first rotation of the minor seventh is determined to be a 6th chord in this embodiment. This is described assuming a root tone of C (FIG. 7).

Figure 7:
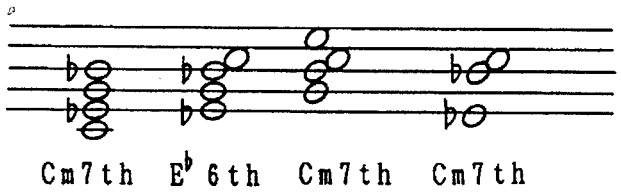
FIG. 7 shows a score that represents the relationship to chord inversions.

The chord written to the left in FIG. 7 is a basic Cm7th, and the first, second, and third inversions are written to the right in that order. In the case of the first inversion, it is the same as the Eb 6th basic form when the root tone is set to Eb (D#). Thus, in this case, the type of chord is determined to be a 6th. The following is processed in the subroutine shown in FIG. 8.

First, when the pattern number (PN) is 3, the judgment in step SPf1–SPf3 becomes "YES" so that processing moves to steps SPf8, where a judgment for KC (0)mod12=(TRT+3) mod12 is made. This determines if the tone name of the lowest bass sound of the pressed key matches the sound which is a minor third above the tentative root tone (TRT). Suppose that the tentative root tone (TRT) is C and the lowest bass tone (KC (0)) is (Eb), which is a minor third higher. This chord then becomes a first inversion of the Cm7th as shown in FIG. 7, namely an E 6th. If judgment is determined to be "YES" in step SPf8, the chord is considered to be a sixth (6th) with the root tone shifted by a minor third, thus proceeding to step SPf10, and the tone when the tentative root tone (TRT) is incremented by a minor third becomes the root tone (RT), and 5 is written into the type number (TP). The type number (TP5) is not listed in Table (1), but it indicates the 6th code.

On the other hand, if step SPf8 results in a "NO", the chord is determined to be a minor seventh (m7th) code, on the tonic, and the tentative root tone (TRT) is adopted as is as the root tone (RT), and the value of the pattern number (PN) is written into the type number (TP) as is.

(4) If the pattern number (PN) is 7:

The pattern number PN7 is an abbreviation of the seventh with suspended fourth (7thsus4) according to the table, but this abbreviation is the same pattern as for the suspended fourth (sus4). In this embodiment, the suspended fourth (sus4) is a less frequent chord and so is designated as a 7thsus4. Also, for the abbreviation of the seventh with a suspended fourth (7thsus4), the interpretation of the root tone differs depending on which tone is absent. Thus, if the tone name of the tentative root tone (TRT) is equal to that of the lowest bass tone, it is considered that the seventh in the table has been abbreviated and the tentative root tone (TRT) is set as the true root tone (RT). In other cases, it is considered that the fifth has been omitted and the tone which is a fifth higher than the tentative root tone (TRT) is set to the root tone (RT). Namely, pattern number PT7 and patterns outside the column in the table are determined to be of the same type of chord.

The above treatment is performed in steps SPf11–SPf14. Namely, in the case of pattern number PN7, judgment in steps SPf1–SPf4 all become "YES", thus leading to step SPf11, where it is determined whether the lowest bass sound is equal to the tentative root and the tentative root tone (TRT) is set to the root tone (RT), with 4 being written into the type number (TP) (steps SPf12 and 14). On the other hand, if judgment is determined "NO" in step SPf11, 4 is written into the type number (TP) after the root tone is rewritten (steps SPf13 and 14).

The root tone (RT) and the type number (TP) which are determined as shown in the above are output to the automatic accompaniment device (12) (See FIG. 1) in step SPa9, thus enabling automatic accompaniment to be made.

In the embodiment (1) A chord is determined based on a specified number of tones starting from the lowest tone pressed without specifying a key register, thus achieving performance that is constrained by the register in which notes are played. (2) A key code (KC) corresponding to an actually generated tone is entered from a keyboard (8), and on this a chord is determined. As a result, the performance feel matches the chord of the automatic accompaniment to be generated.

Modification example (1) It is possible to use any other detection patterns including those shown in the embodiment for the chord pattern to be detected.

(2) In the embodiment, 4 or 3 tones were taken out of the lowest bass tone to detect the chord. The number of tones used to determine the chord may be set to some other number.

(3) In the embodiment, a key register for enabling chord to be detected is not divided, but may be divided into lower and upper registers, thus enabling a chord to be determined based on the keys pressed in the lower register (or upper-register).

What is claimed is:

1. An electronic musical instrument comprising:

(a) a performance information input means for inputting performance information representing notes corresponding to a sound to be generated;

(b) a first lower tone extracting means for extracting a first predetermined number of notes from among said notes, from lowest pitch to highest pitch;

(c) a chord detection means for detecting a chord based on said extracted notes, said chord detection means having a nondetection condition when a chord is not detected;

(d) an automatic accompaniment means for creating an automatic accompaniment signal based on said detected chord; and (e) a second lower tone extracting means, responsive to the nondetection condition of said chord detection means, for re-extracting a second predetermined number of notes from among said notes, from lowest pitch to highest pitch, said second predetermined number being less than said first predetermined number and said chord detection means detecting a chord based on said re-extracted notes.

2. An electronic musical instrument according to claim 1, wherein said second predetermined number is less than said first predetermined number by one.

3. An electronic musical instrument comprising:

(a) a performance information input means for inputting performance information representing notes corresponding to a sound to be generated;

(b) a lower tone extracting means for extracting a predetermined number of notes from among said notes, from lowest pitch to highest pitch;

(c) a chord detection means for detecting a chord based on said extracted notes;

(d) an automatic accompaniment means for creating an automatic accompaniment signal based on said detected chord; and (e) a chord table memory having stored therein abbreviated chord patterns representing plural chords respectively, wherein each chord of said plural chords is represented by an abbreviated chord pattern, and wherein said chord detection means detects said chord by comparing said extracted notes with said chord patterns and said abbreviated chord patterns.

4. An electronic musical instrument comprising:

a performance information input means for inputting performance information representing notes corresponding to a sound to be generated;

a chord table memory having stored therein chord patterns representing plural chords respectively, wherein at least one of said plural chords is also represented by an abbreviated chord pattern;

a chord detection means for detecting a chord by comparing said performance information with said chord patterns and said abbreviated chord pattern under a condition that said abbreviated chord pattern is prioritized over infrequently occurring one or ones of said chord patterns; and an automatic accompaniment means for creating an automatic accompaniment signal based on said detected chord.

5. An electronic musical instrument according to claim 4, wherein when said chord table memory stores said abbreviated chord pattern in regard to a predetermined key, said chord detection means having means for transposing said performance information with one of said chord patterns and said abbreviated chord pattern.

6. An electronic musical instrument according to claims 1 or 2, wherein said performance information input means is a keyboard, and said first and second lower tone extracting means correspond to keys belonging to a specified key region of said keyboard.

7. An electronic musical instrument comprising:

a performance information input means for inputting performance information representing notes corresponding to a sound to be generated;

a lower tone extracting means for extracting a first predetermined number of notes from among said notes, from lowest pitch to highest pitch, wherein the predetermined number of notes is less than all of said notes;

a chord detection means for detecting a chord based on said extracted notes; and an automatic accompaniment means for creating an automatic accompaniment signal based on said detected chord.

8. An electronic musical instrument according to one of claims 1 through 5 and 7, wherein said performance information input means is a keyboard.

9. An electronic musical instrument according to claims 1 or 7, wherein said performance information input means is a keyboard, and said lower tone extracting means corresponds to keys belonging to a specified key region of said keyboard.

10. An electronic musical instrument comprising:

a keyboard having a plurality of keys that a performer can depress to play a melody and an accompaniment simultaneously;

performance information detecting means for detecting performance information representing key depressions and pitches with respect to depressed keys among said plurality of keys;

musical tone producing means for producing musical tone signals having pitches corresponding to the depressed keys on the basis of said performance information;

chord name detection means for detecting a chord name corresponding to the pitches represented by said performance information;

determining means for determining whether or not said chord name detection means has detected the chord name;

chord name providing means, responsive to the determining means, to provide the chord name detected by the chord name detection means; and automatic accompaniment means for performing an automatic accompaniment based on said chord name provided by said chord name providing means.

11. A method of determining a chord for an electronic musical instrument, the method comprising the steps of:

inputting performance information representing notes corresponding to a sound to be generated;

extracting a first predetermined number of notes from among said notes, from lowest pitch to highest pitch;

detecting a chord based on said extracted notes;

indicating a non-detection condition when a chord is not detected;

re-extracting a second predetermined number of notes from among said notes, from lowest pitch to highest pitch, in response to the non-detection condition, said second predetermined number being less than said first predetermined number;

detecting a chord based on said re-extracted notes; and creating an automatic accompaniment signal based on said detected chord.

12. A method according to claim 11, wherein said second predetermined number is less than said first predetermined number by one.

13. A method of selecting a chord for an electronic musical instrument, the method comprising the steps of:

storing abbreviated chord patterns representing plural chords respectively in a chord table memory, wherein each chord of said plural chords is represented by an abbreviated chord pattern;

inputting performance information representing notes corresponding to a sound to be generated;

extracting a predetermined number of notes from among said notes, from lowest pitch to highest pitch;

detecting a chord based on said extracted notes, wherein the chord is detected by comparing said extracted notes with said chord patterns and said abbreviated chord patterns; and creating an automatic accompaniment signal based on said detected chord.

14. A method of selecting a chord for an electronic musical instrument, the method comprising the steps of:

inputting performance information representing notes corresponding to a sound to be generated;

storing chord patterns representing plural chords respectively in a chord table memory, wherein at least one of said plural chords is also represented by an abbreviated chord pattern;

detecting a chord by comparing said performance information with said chord patterns and said abbreviated chord pattern under a condition that said abbreviated chord pattern is prioritized over infrequently occurring one or ones of said chord patterns; and creating an automatic accompaniment signal based on said detected chord.

15. A method according to claim 14, further comprising the steps of:

storing said abbreviated chord pattern in regard to a predetermined key; and transposing said performance information with one of said chord patterns and said abbreviated chord pattern.

16. A method of selecting a chord for an electronic musical instrument, the method comprising the steps of:

inputting performance information representing notes corresponding to a sound to be generated;

extracting a first predetermined number of notes from among said notes, from lowest pitch to highest pitch, wherein the predetermined number of notes is less than all of said notes;

detecting a chord based on said extracted notes; and creating an automatic accompaniment signal based on said detected chord.

17. A method of selecting a chord for an electronic musical instrument, the method comprising the steps of:

providing a keyboard having a plurality of keys that a performer can depress to play a melody and an accompaniment simultaneously;

detecting performance information representing key depressions and pitches with respect to depressed keys among said plurality of keys;

producing musical tone signals having pitches corresponding to the depressed keys on the basis of said performance information;

detecting a chord name corresponding to the pitches represented by said performance information;

determining whether or not the chord name has been detected;

providing the chord name to an automatic accompaniment portion of the electronic musical instrument if the chord name has been detected; and performing an automatic accompaniment based on the provided chord name.

* * * * *